US005476073A

United States Patent [19]

Betts

[11] Patent Number: 5,476,073

[45] Date of Patent: Dec. 19, 1995

[54] DIESEL ENGINE WASTE OIL RECYCLING SYSTEM

[76] Inventor: Harold S. Betts, 609 Summer St., Waynesboro, Mass. 39367

[21] Appl. No.: 173,569

[22] Filed: Dec. 27, 1993

[51] Int. Cl.[6] ..... F02B 33/04

[52] U.S. Cl. ..... 123/73 AD; 123/196 A; 123/1 A

[58] Field of Search ..... 123/196 R, 196 A, 123/196 S, 73 AD, 1 A; 184/1.5

[56] References Cited

U.S. PATENT DOCUMENTS

| | | | |
|---|---|---|---|
| 3,929,645 | 12/1975 | Bugelski et al. | 210/250.60 |
| 4,495,909 | 1/1985 | Hurner | 123/196 A |
| 4,674,456 | 6/1987 | Merritt | 123/196 S |
| 4,869,346 | 9/1989 | Nelson | 123/196 S |
| 5,203,429 | 4/1993 | Zager | 123/196 R |
| 5,238,085 | 8/1993 | Engelmann | 123/196 S |
| 5,353,760 | 10/1994 | Zager | 123/196 S |

FOREIGN PATENT DOCUMENTS

| | | | |
|---|---|---|---|
| 0056507 | 1/1981 | Japan | 184/1.5 |
| 0012009 | 2/1981 | Japan | 123/73 AD |
| 0014414 | 1/1986 | Japan | 123/73 AD |

*Primary Examiner*—Henry C. Yuen
*Assistant Examiner*—Erick Solis
*Attorney, Agent, or Firm*—Harold E. Meier

[57] ABSTRACT

During servicing, used lubricating oil is pumped (7) from the sump of a compression ignition engine (4) crankcase to a reservoir means (8), then filtered (10) and mixed (2) with fuel oil returning (12) to a supply tank (14). The filtered (10) used lubricating oil is effectively mixed (2) with the fuel (12) for burning in the engine (4).

4 Claims, 2 Drawing Sheets

DIESEL ENGINE WASTE OIL RECYCLING SYSTEM

BACKGROUND-FIELD OF INVENTION

The instant invention relates to the recycling of used motor oil, specifically to such oil used by compression ignition engines.

BACKGROUND-DESCRIPTION OF PRIOR ART

Numerous ways have been addressed to methods of disposing of waste motor oil. While these methods may be suitable for the particular purpose to which they address, they would not be as suitable for the purposes of the present invention as heretofore described.

In recent years a number of proposals have been made to recycle used engine lubricating oil after appropriate treatment so that it may be added to fuel oil burned by a compression ignition engine. One earlier proposal for this may be found in U.S. Pat. No. 3,929,645 to Bugelski and Teasley (1975). In that Patent used crankcase oil was extracted from an engine and mixed with fuel oil from the engine fuel tank before it is filtered and passed to the engine fuel tank for consumption. This device generally is effective in accomplishing proper mixing and filtering of oil for suitable consumption by the engine. Under certain conditions; however, problems in its operation may be experienced. The output of the lubricating oil and fuel oil pump are directly connected. As a result, priming of one pump before the other can cause the output of the primed pump to prevent the other pump from passing any fluid at all. This inhibits proper mixing and operation of the device. These and other such devices are experiencing environmental impact problems at this time.

OBJECTS AND ADVANTAGES

A Primary objective of the present invention is to provide a means for disposing of used motor oil by collecting, storing, dispensing, and otherwise recycling it back into the same said diesel engine that it came out of as both a fuel and a fuel lubricant.

Another objective is to effectively help conserve energy by using waste oil as a fuel that reduces to a degree the demand on diesel fuel and reduces waste disposal cost.

A still further objective is to reduce the spills, waste, contamination, etc. created by conventional drain methods causing environmental impact.

To solve the problems it has been proposed to filter the used oil after draining and add it to the fuel oil that will be burned by a compression ignition engine. This is possible because the fuel oil and the lubricating oil have the same general characteristics. However, prior approaches have been marginally effective in completely mixing the lubricating oil with the fuel oil and removing oil contaminants.

These problems are solved in accordance with the present invention by a system in which used lubrication oil is extracted from the sump of a compression ignition engine, then filtered, then blended, before it is added to a tank of fuel that will be consumed by the engine.

The above and other related features of the present invention will be apparent from a reading of the following description of the disclosure shown in the accompanying drawing and novelty thereof pointed out in the appended claims.

Most internal combustion engines have a system for lubricating their rotating and moving components. In time the oil used in these systems becomes contaminated with metal particles, dirt, coolant, and sludge. Because of this, it is necessary to change oil at periodic intervals. When oil is changed, the used oil must be disposed of. Recently, local ordnances have severely limited the techniques for disposal of waste oil.

In most cases, the disposal of this used lubricating oil is a significant expense. Until the recent fuel shortages, vehicle service centers would have to pay to have the used oil taken away. At present, used oil is removed at no cost or for a slight payment per gallon. However, this method of disposing of the oil still requires an investment in storage tanks for accumulation prior to removal. In some fleet operations there would only be need for one transfer pump and transfer conduit to transfer used oil from the engine sump to the reservoir tank.

In certain installations, the disposal of used oil is prohibitively expensive. On offshore drilling rigs and certain islands, the used oil must be transported by sea back to a mainland disposal site. The cost of shipping the oil makes disposal a significant proportion of the operating costs. In some cases such as peace keeping missions such as the military operations on foreign soils, machinery such as trucks, generators, etc. could be properly serviced quickly and efficiently without waste or environmental impact.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DRAWING FIGURES

REFERENCE NUMERALS IN DRAWINGS

Figure 1:
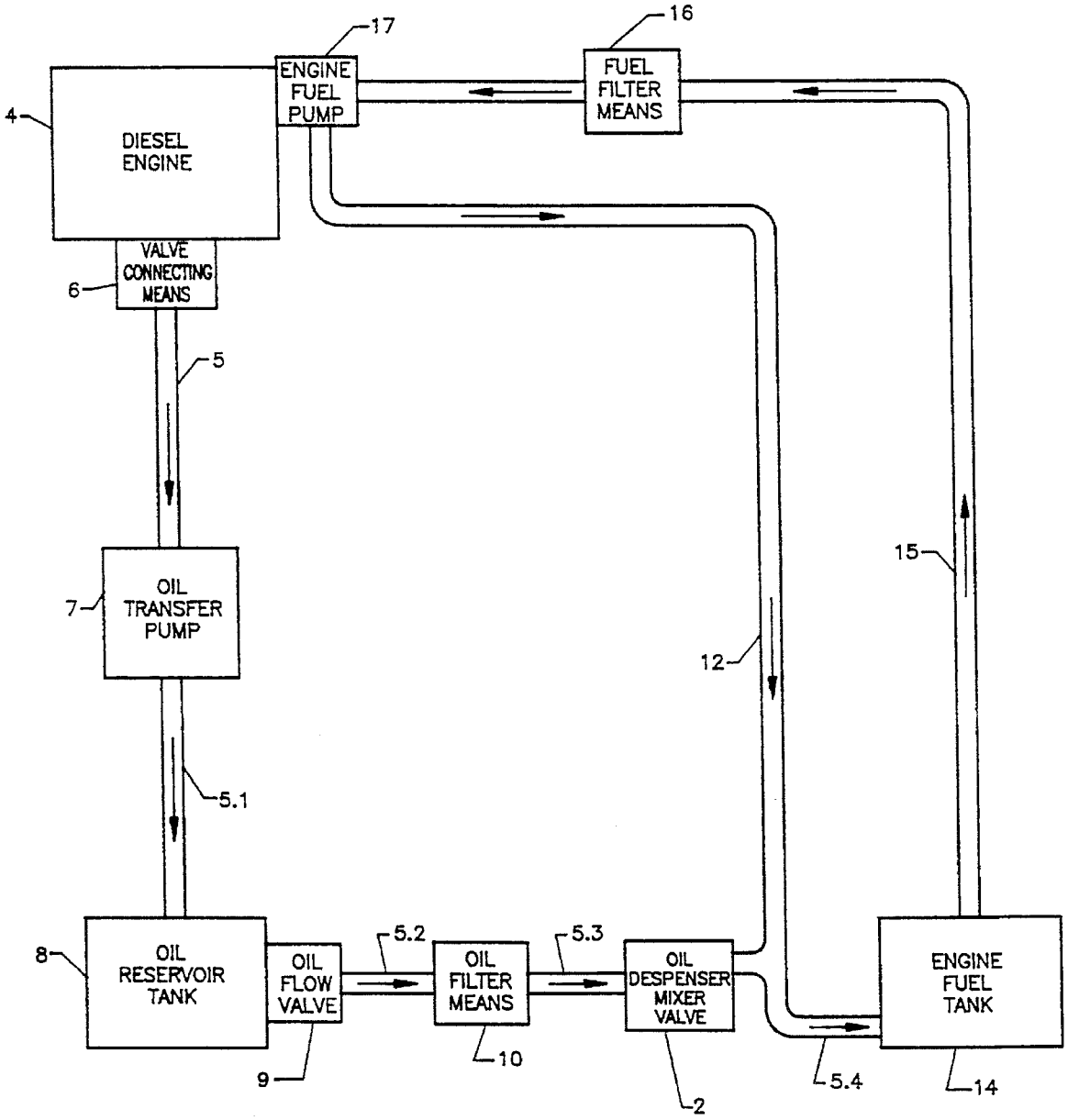
FIG. 1 shows, schematically, a compression ignition engine, a means for extracting used lubricating oil from the engine, storing it in a reservoir, filtering and adding it to the fuel supply tank.
Figure 2:
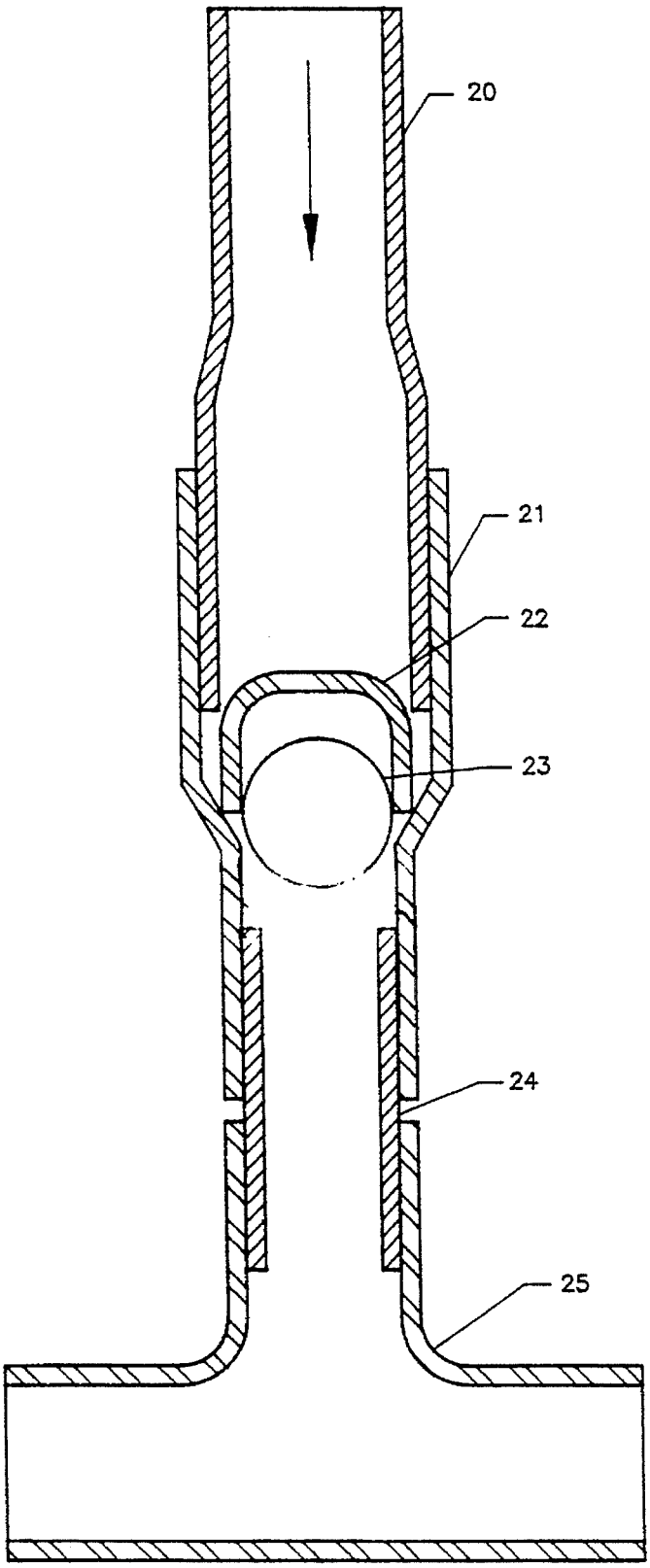
FIG. 2 is a longitudinal section view of the dispenser/mixer incorporated in the system of FIG. 1.

| | |
|---|---|
| 1 the system | 14 engine fuel tank |
| 2 dispenser/mixer | 15 engine fuel supply line |
| 4 diesel engine | 16 fuel filter means |
| 5–5.4 conduit means | 17 engine fuel pump |
| 6 valved connection | 20 conduit reducer, smaller |
| 7 oil transfer pump | 21 conduit reducer, larger |
| 8 oil reservoir tank | 22 conduit cap |
| 9 oil flow valve | 23 bearing ball |
| 10 filter means | 24 conduit nipple |
| 12 fuel return line | 25 conduit tee |

DESCRIPTION

The above and other related features of the present invention will be apparent from reading of the following description of the disclosure shown in the accompanying drawings and the novelty thereof pointed out in the appended claims.

The drawing shows a compression ignition engine 4 that burns fuel oil from a supply line 15. A fuel delivery means for delivering fuel from the tank to the injection means at a rate normally in excess of that which the fuel is injected by the injection means, fuel return means for returning the heated excess fuel from the injection means to both the said dispenser/mixer valve and the fuel supply tank.

The operating principles of the compression ignition engine and the manner in which fuel oil is metered to the individual cylinders is so well known by those skilled in the art that details of the components will not be discussed to simplify the description. The fuel supply line 15 receives pressurized fuel from an engine driven pump 17 a fuel line 15 to a fuel storage tank 14 having a filler opening (not shown). If the engine 4 is used to power a vehicle, the fuel tank 14 would be mounted at some point on the vehicle. If engine 4 is used in a stationary installation, both the fuel tank 14 and engine 4 would be permanently mounted, although not necessarily on the same base.

Engine 4 has a lubricating system which oil is pressurized by a pump (not shown) for deliverance through a filter (not shown) to suitable passages (not shown) for lubricating the rotating pans in the engine 4. The oil then is returned to a sump (not shown) secured to the bottom of the engine crankcase (not shown).

In accordance with the present invention the system 1 removes used lubricating oil from the engine sump (not shown) to a reservoir 8 to utilize this system, engine sump (not shown) preferably is fitted with a flexible hose or conduit 5 extending from a low point in the sump (not shown) to quick disconnect fitting 6 located at a point permitting ready access. In many cases, it would be possible to connect the flexible hose or conduit 5 to the sump (not shown) at the fitting that receives the usual drain plug (not shown).

The system 1 comprises a reservoir tank 8 with a quantity sufficient capacity to receive total capacities of the engine sump, (not shown) the lubricating oil filters (not shown) the engine fuel oil filters 16. The system 1 also comprises a filter housing 10 in the form of an upright cylindrical chamber having a base 10. Different filter housings may be used for this purpose.

Filter head means 10 and transfer pump means 7 being mounted to suitable locations. Transfer pump means 7 may be any suitable type capable of pumping lubricating oil or fuel oil such as a centrifugal type or a gear type.

A flexible conduit means 5–5.4 extends from the outlet of the engine sump (not shown) to the transfer pump means 7 to the reservoir tank 8 and from the reservoir tank 8 to the filtering means 9 to the dispenser mixer valve means 2 to the fuel supply tank 14. To interconnect the system 1 with the engine 4 a flexible conduit 5 extends from the quick disconnect fitting 6 at the engine sump (not shown) outlet 6 to the transfer pump means 7 a second flexible conduit means 5.1 from the transfer pump means 7 to the reservoir tank means 8 a third flexible conduit 5.2 from the valve 9 on the reservoir tank means 8 to the filtering means 10 a fourth conduit means 5.3 from the filtering means 10 to the dispenser/mixer valve means 2, a fifth flexible conduit 5.4 from the dispenser/mixer valve means 2 to the engine fuel supply tank 14 above the upper level of fuel in the fuel supply tank 14.

The above problems are solved by the present invention which comprises a mixing means 2 connected through a tee 25 to the engine excess fuel return conduit 12 to carry the mixed fuel oil and lubricating oil to the engine fuel oil tank 14.

The apparatus 2 comprises a swage type conduit reducer 21 of a size larger than another swage type conduit reducer 20 in which the smaller of the reducers 20 fits inside the larger of the reducers 21 and forms a shell type housing for the apparatus. A bearing ball 23 is fashioned a seat in the neck of the larger swage 21. A conduit cap 22 of sufficient size is fashioned to a bell shape and placed over the beating ball 23 so as to cover it, but with sufficient clearance inside of the conduit cap 22 to allow the bearing ball 23 adequate movement for dispensation to take place. Buoyancy of the conduit cap 22 will vary with temperature and viscosity factors. The chamber is spliced together. The tee 25 is spliced to the chamber 21 with the nipple 24. The tee 25 is for the excess fuel return line 12 to enter the valve assembly 2 receive quantity sufficient used oil and then continue on to the engine fuel tank 14 for further dilution and to be burned as fuel for compression ignition engine.

OPERATION

The system 1 operation begins when the engine 4 is shut down for servicing. Servicing of engine 4 at specified intervals includes changing of oil in sump (not shown) and changing of oil filters (not shown) along with other items such as fuel oil filters 16 etc.

Conduit 5 with quick disconnect 6 is connected to engine sump (not shown). Transfer pump means 7 is turned on to facilitate transfer to reservoir tank means 8. The transfer pump continues to operate until all the lubricating oil is pumped from sump (not shown). After sump oil is transferred to reservoir tank 8 the quick disconnect 6 is disconnected and the transfer pump turned off. The engine 4 is replenished with new lubricating oil. The system 1 allows the used oil to flow by gravity from the reservoir tank 8 through the filtering means 10, through the dispenser/mixer means 2, to the excess warm fuel return line means 12 returning warm excess engine fuel to the fuel supply tank 14. This also warms the mixer dispenser valve 2. Thus system 1 being motivated by engine operation only. Warm excess return fuel also warms the mixer/dispenser valve 2 to produce a good blend of lubricating oil and fuel oil even in cold weather.

SUMMARY, RAMIFICATIONS, AND SCOPE

The above system 1 is highly effective in utilizing used lubricating oil as an additive in fuel oil to dispose of it. The system 1 effectively removes the larger particulate matter commonly found in used lubricating oil. It should be apparent to those skilled in the art that the system 1 may have a different physical arrangement and still fall within the spirit and scope of the present invention.

Calculated annual savings per truck: Oil pan capacity ten gallons, average, times number of oil changes per year, seven average, equals fuel saved seventy gallons, estimated per unit per year, times diesel fuel cost per gallon, one dollar per gallon, estimated, equals seventy dollars saved per unit per year.

Oil properly mixed with diesel fuel should cause no more pollution than does regular diesel fuel. Plus there are a number of technological products such as catalytic converters to neutralize such effects.

Goal is to meter or dispense used motor oil into the fuel system at a slow enough rate so as not to over contaminate the fuel system but will still be used up as fuel before the next engine oil change is due.

Turbo or super charged type diesel engines are the best candidates for this system. Even though the oil will be combusted as a fuel, the combustion temperature will be cooler allowing the blowers to increase air without overheating internal engine parts.

Oils capable of absorbing more contaminates thus extending oil change periods will allow even smaller doses of oil to be added to the fuel.

Oil saved or recycled as fuel will amount to eight to ten gallons average every oil change. This adds up to savings in fuel cost not to mention, the exploration, production, and distribution cost. Then having to dispose of it as waste. Waste disposal becoming harder and more expensive.

This process should dispense and dispose of otherwise wasted and unused oils between service periods and not over contaminate the fuel system or the environment.

To provide a means to offset higher fuel prices brought on by the low sulfur fuel standards now in place for all road use diesel fuels. To replace some of the lubricant lost in lowering the sulfur content of road diesel fuels.

Although the description above contains many specificities, these should not be construed as limiting the scope of the invention but as merely providing illustrations of some of the presently preferred embodiments of this invention. For example, the dispenser/mixer may be of larger or smaller diameters, the reservoir tanks made of metal, fiberglass, or plastic, etc. The bearing balls may be of glass, plastic, steel, lead, etc. as well as different diameters. Conduits may be of different sizes, shapes, etc.

Thus the scope of the invention should be determined by the appended claims and their legal equivalents, rather than by the examples given.

Having thus described the invention, what is claimed as novel and desired to be secured by Letters Patent of the United States is:

1. A system for addition of used lubricating oil to fuel oil to be burned by a compression ignition engine, said system comprising:

a disconnect means releasibly connected to the compression ignition engine and having an outlet;

a pump having an inlet for receiving used lubricating oil from the disconnect means and having an outlet;

a reservoir having an inlet for receiving from the pump used lubricating oil and having a valved outlet;

filter means having an inlet for receiving from the reservoir used lubricating oil and having an outlet;

mixing means for receiving the used, filtered lubricating oil from the filter means and excess fuel oil and having an inlet and an outlet, said mixing means including:

a first conduit reducer;

a second conduit reducer fitting inside the first conduit reducer;

a ball bearing resting in the neck of said first conduit reducer;

a conduit cap covering the ball bearing and allowing the ball bearing adequate movement for dispensing the lubricating oil into the mixing means; and a nipple attaching the tint conduit reducer to a tee, wherein the tee is used to allow the excess fuel oil into the mixer means and to further allow the mixture of fuel oil and lubricating oil to enter into the engine fuel tank; and a fuel tank having an inlet connected to the mixing means.

2. A system for addition of used lubricating oil to fuel oil to be burned by a compression ignition engine, said system comprising:

a disconnect means releasibly connected to the compression ignition diesel engine and having an outlet;

a pump having an inlet for receiving used lubricating oil and an outlet;

a reservoir having an inlet for receiving used lubricating oil and a valved outlet;

filter means having an inlet for receiving used lubricating oil and an outlet;

mixing means for receiving the used, filtered lubricating oil and excess fuel oil having an inlet and an outlet;

a fuel tank having an inlet;

first conduit means extending from the outlet of the disconnect means to the inlet of the pump;

second conduit means extending from the outlet of the pump to the inlet of the reservoir;

third conduit means extending from the valved outlet of the reservoir to the inlet of the filter means;

fourth conduit means extending from the outlet of the filter means to the inlet of the mixing means; and fifth conduit means extending from the outlet of the mixing means to the inlet of a fuel oil tank.

3. A system as in claim 2 wherein said mixing means mixes a greater portion of fuel oil than used, filtered lubricating oil.

4. A system for addition of used lubricating oil to fuel oil to be burned by a compression ignition engine, said system comprising:

means for extracting used lubricating oil from the compression ignition engine;

means for receiving and storing the extracted lubricating oil for further processing;

means for filtering the extracted lubricating oil;

means for mixing the filtered lubricating oil with fuel oil wherein the mixing means includes a first and second conduit reducer, a ball bearing, a conduit cap, a nipple and a tee; and means for adding the mixture of filtered lubricating oil and fuel oil to a fuel tank.

* * * * *

UNITED STATES PATENT AND TRADEMARK OFFICE

CERTIFICATE OF CORRECTION

PATENT NO. : 5,476,073

DATED : December 19, 1995

INVENTOR(S) : Harold S. Betts

It is certified that error appears in the above-indentified patent and that said Letters Patent is hereby corrected as shown below:

Column 4, line 5, "beating" should be --bearing--.

Column 6, line 3, "tint" should be --first--.

Signed and Sealed this

Nineteenth Day of March, 1996

*Attest:*

Bruce Lehman

BRUCE LEHMAN

*Attesting Officer*

*Commissioner of Patents and Trademarks*